US007599509B2

(12) United States Patent
Ito

(10) Patent No.: US 7,599,509 B2
(45) Date of Patent: Oct. 6, 2009

(54) HEADPHONE, ELECTRONIC DEVICE, CORD WINDING DEVICE, AND CORD WINDING METHOD

(75) Inventor: Tomohiro Ito, Kanagawa (JP)

(73) Assignee: Sony Corporation, Tokyo (JP)

( * ) Notice: Subject to any disclaimer, the term of this patent is extended or adjusted under 35 U.S.C. 154(b) by 563 days.

(21) Appl. No.: 10/565,155

(22) PCT Filed: May 20, 2005

(86) PCT No.: PCT/JP2005/009721

§ 371 (c)(1),
(2), (4) Date: Jan. 19, 2006

(87) PCT Pub. No.: WO2005/115048

PCT Pub. Date: Dec. 1, 2005

(65) Prior Publication Data

US 2008/0192975 A1 Aug. 14, 2008

(30) Foreign Application Priority Data

May 21, 2004 (JP) ..... 2004-152465

(51) Int. Cl.
*H04R 25/00* (2006.01)

(52) U.S. Cl. ..... 381/384; 381/370

(58) Field of Classification Search ..... 381/370, 381/371, 374, 384; 439/501; 379/430, 433.05, 379/438, 451; 455/351
See application file for complete search history.

(56) References Cited

U.S. PATENT DOCUMENTS 5,339,461 A * 8/1994 Luplow ..... 455/351
6,480,611 B2 * 11/2002 Hashimoto et al. ..... 381/371

FOREIGN PATENT DOCUMENTS

| | | |
|---|---|---|
| JP | 63-109525 | 7/1988 |
| JP | 6-81194 | 11/1994 |
| JP | 9-187092 | 7/1997 |
| JP | 2001-189983 | 7/2001 |
| JP | 2002-10385 | 1/2002 |
| JP | 2002-101484 | 4/2002 |

* cited by examiner

*Primary Examiner*—Huyen D Le
(74) *Attorney, Agent, or Firm*—Oblon, Spivak, McClelland, Maier & Neustadt, L.L.P.

(57) ABSTRACT

An input cord used in a headphone apparatus and an electronic apparatus is wound around a winding device such as a reel, and assembly is facilitated without using jigs when a commutator mechanism relaying to a D/U on the other side through a passage cord is installed. A terminal board including metal slip rings is provided on the side of a lower flange of a reel in left and right headphone housings, and contact points are provided on the side of a housing at a position opposed to the terminal board.

14 Claims, 11 Drawing Sheets

HEADPHONE, ELECTRONIC DEVICE, CORD WINDING DEVICE, AND CORD WINDING METHOD

TECHNICAL FIELD

The present invention relates to a reel winding device and reel winding method in which a cord is wound and retracted onto a reel provided in a headphone housing or in a casing of an electronic apparatus, and particularly to a headphone apparatus and an electronic apparatus, as well as a cord-winding device and cord-winding method, in which the position of a commutator mechanism having contact points and metal slip rings arranged in a cord-winding device has been improved.

BACKGROUND ART

Regarding an electronic apparatus such as a portable radio and a headphone apparatus, there has been an apparatus that incorporates winding means winding and retracting an input cord and passage cord of headphones, in which these cords are energized by the force of a spring so as to be wound and retracted inside, locking means for locking only at the time of winding is provided, the cords are pulled out with necessary lengths against the locking means when the earphones or headphones are used, and the cords are wound by the force of the spring at the time of storage, with a release button which releases the locking means being pushed.

Cord-winding means used for the above described headphone apparatus has been disclosed in Patent Literature 1. FIG. 8 shows the whole structure of a headphone apparatus disclosed in the above-described Patent Literature 1, and FIG. 9 is a cross-sectional view of FIG. 8 shown by the A-A line. In FIG. 8, regarding left and right headphone housings 1L and 1R, shell-like front and rear housings 2*a* and 2*b* constitute a casing as shown in FIG. 9, in which a drive unit (hereinafter referred to as D/U) 3 of such as a loudspeaker, which is an electro-acoustic transducer, is attached to the front housing 2*a*, a sound hole la which radiates acoustic pressure generated from the D/U is provided in the front surface of the front housing 2*a*, and an ear pad 4 is provided on the front surface of the front housing 2*a*.

Normally, a headphone apparatus is worn on the left and right ears, so that, as shown in FIG. 8, an input cord 9 extending from an input plug 8 having a connection terminal 8*a* connected to an electronic apparatus is pulled into one casing, for example, into the left headphone housing 1L and is connected to the D/U 3 in the left headphone housing 1L. A lead wire 10 is a passage cord to be pulled into the right headphone housing 1R and is connected to the D/U 3 in the right headphone housing 1R. On the passage cord 10 is slidably held a slider 11 for adjusting freely the length of the passage cord 10 when folded. Further, a protruding portion 2*c* constituting holding means is formed on the left and right headphone housings 1L and 1R. An insertion opening 2*d* into which the input plug 8 can be inserted is provided in the protruding portion 2*c*.

When winding and retracting the input cord 9 with the input plug 8 being held by the insertion opening 2*d* of the protruding portion 2*c* constituting holding means, locking means which locks and prevents the input cord 9 from being wound and retracted by later-described winding means energizing to wind and retract the cord into the left headphone housing 1L is released, and thus the input cord 9 is wound and retracted by the winding means, however, since the input plug 8 has been held by the protruding portion 2*c* of the holding means in advance, the input plug 8 is not pulled in along with the input cord 9, and the input plug is therefore prevented from hitting the human body at the time of winding. In addition, reference numerals 4, 5 and 7 in FIG. 8 are an ear pad, a supporting portion and an ear hook respectively, which are described later on.

Next, the internal structure of the left and right headphone housings 1L and 1R is explained referring to FIGS. 9 to 11. FIG. 9 is a side sectional view of a headphone housing portion that incorporates winding means, FIG. 10 is an enlarged sectional view of the portion B in FIG. 9, and FIG. 11 is a plan view in which the internal structure of cord-winding means is seen.

The internal structure of a headphone apparatus is explained referring to FIG. 9 as follows: a pair of spindle portions 5 is provided in the vicinity of the rear housing 2*b* (refer to FIGS. 8 and 9), a spindle 5*a* protrudes from inside the spindle portions 5, a coiled spring 6 is put around the spindle 5*a*, and the spindle 5*a* is energized by the coiled spring 6 such that an end 7*a* of the ear hook 7 fitted into a spindle hole of the spindle portions 5 to be able to turn freely will always be energized toward the front housing 2*a*. The ear hook 7 has a pressed portion 7*b* on the opposite side to the end 7*a* with respect to the spindle 5*a*, a slip stopper 7*c* is provided in the pressed portion 7*b*, and by pressing the part with the fingers, the end 7*a* of the ear hook 7 moves apart from the front housing 2*a*.

As regards winding means, a board 12 made of metal or the like is fixed with a plurality of screws or the like to the front housing 2*a* of the left headphone housing 1L into which the input cord 9 is pulled. One end of a rotating shaft 13 functioning as a pivot stands at the center of the board 12; a reel 14 is inserted and fitted into the rotating shaft 13 in a freely rotatable manner; a spring 15, both ends of which are fixed between the reel 14 and the rotating shaft 13, is accommodated in a hollow 14*a* of the reel 14; and the spring 15 is pressed by a pressing board 16 so as not to jump out, and is prevented from detaching by means of a C ring 13*a* from above the pressing board 16 at the other end of the rotating shaft 13. A plurality of protrusions 12*b* are provided on the lower surface of a lower flange 14*d* of the reel 14 to reduce friction by point-contacting the board 12 when the reel 14 rotates.

As shown in FIG. 9 and FIG. 10 that is an enlarged view of the portion B in FIG. 9, ends of an L-channel lead wire 9*a*, a ground (G) common lead wire 9*b* and an R-channel lead wire 9*c*, which are cords in the input cord 9 wound and retracted onto the reel 14, are electrically connected to brush-like contact points 18*a*, 18*b*, 18*c*, made of resilient metal boards, respectively, in a bored portion 14*b* formed between the board 12 and the hub of the reel 14, and the brush-like contact points 18*a*, 18*b*, 18*c* are concentrically installed in the bored portion 14*b*. On the other hand, on a terminal board 17 attached to the board 12 are provided metal slip rings 19*a*, 19*b*, 19*c* which correspond to the brush-like contact points 18*a*, 18*b*, 18*c*, constituting a commutator mechanism such that the contact points 18*a*, 18*b*, 18*c* are pressed to be contacted.

Therefore, when the reel 14 rotates, a sound signal input through the input cord 9 is transmitted to the terminal board 17 without being interrupted by contact and sliding between the brush-like contact points 18*a*, 18*b*, 18*c*, made of resilient metal boards, and the metal slip rings 19*a*, 19*b*, 19*c*, and then is transmitted from the terminal board 17 to terminals 3*b*, 3*c* of a terminal board 3*a* through lead wires 17*a*, 17*b*. Among the lead wires in the input cord 9, the common lead wire 9*b* and the R-channel lead wire 9*c* are connected to the right headphone housing 1R on the other side through lead wires

17*c*, 17*d* electrically connected with these lead wires 9*b*, 9*c*, and through the passage cord 10 which combines the lead wires 17*c* and 17*d* together.

Further, regarding locking means, the outer circumference of the lower flange 14*d* on the board 12 side in the two flanges of the reel 14 is divided by n to form repeatedly saw-like recesses and projections, thus constituting a plurality of ratchet wheels 14*c* as shown in FIG. 11. A shaft 20 is planted in an upright position in a protruding piece 12*c* of the board 12, and an approximately T-shaped locking piece 21 is attached to the shaft 20 in a freely turnable manner. Regarding the locking piece 21, an operational portion 21*a*, with which the end of the connection terminal 8*a* of the input plug 8 is brought in contact, protrudes; a locking portion 21*b* is provided at a position where the ratchet wheels 14*c* on the periphery of the lower flange 14*d* of the reel 14 is in contact; and is energized in the counterclockwise direction C in FIG. 11 by a spring 22 provided between a hooking portion 21*c* and a hooking portion 12*d* of the board 12, and therefore the locking portion 21*b* is always pressed to be in contact with the ratchet wheels 14*c* formed on the periphery of the lower flange 14*d*.

Further, regarding holding means, in the protruding portion 2*c* of the rear housing 2*b* is provided an insertion opening 2*d* from which the connection terminal 8*a* of the input plug 8 is inserted, and a small diameter portion in the vicinity of the end thereof can be held by a protruding portion of a holding spring board 23.

As regards conductive state in a commutator mechanism including the above-described brush-like contact points 18*a*, 18*b*, 18*c* and metal slip rings 19*a*, 19*b*, 19*c*, in order to retain conductivity without interruption with respect to rotation movement for which durability against repeated actions is required, the brush-like contact points 18*a*, 18*b*, 18*c* need to be accurately assembled, however, from a structural viewpoint, there have been difficulties in production with the above-described structure. Specifically, as in FIGS. 12A to 12C showing a similar structure to FIG. 10, in order for a reel 14 to wind and store an input cord 9 as much as possible in a limited space, a space for a bored portion 14*b* used for providing brush-like contact points 18*a*, 18*b*, 18*c* is extremely limited, and so it has been necessary for the bored portion 14*b* having small area provided at the lower end of the hub of the reel 14 to have minimal values regarding both the thickness T and diameter D thereof. Accordingly, there has been a problem in which the thickness of the reel 14 is reduced as thin as possible as shown in FIGS. 12A to 12C, and the area of a distance D1 (refer to FIG. 12B) of a terminal pedestal 25 for the brush-like contact points 18*a*, 18*b*, 18*c* welded to the inside of the bored portion 14*b* is tiny.

Further, with a structure in which the brush-like contact points 18*a*, 18*b*, 18*c* are fixed to the bored portion 14*b* formed at the lower end of the hub of the reel 14 and the metal slip rings 19*a*, 19*b*, 19*c* are provided on the terminal board 17 side of the board 12 fixed to the front housing 2*a* or rear housing 2*b*, not only a jig 27 for inserting a welding pin 26 provided in an upright position on the terminal pedestal 25 into a through-hole made in the brush-like contact points 18*a*, 18*b*, 18*c*, and a jig 27*a* for welding the brush-like contact points 18*a*, 18*b*, 18*c* to the welding pin 26 are required in the small-area bored portion 14*b* as shown in FIGS. 12A to 12C, but also with the jig 27 for exclusive use, adjustment is complicated in heat-welding the metal brush-like contact points 18*a*, 18*b*, 18*c* to the thin terminal pedestal 25 and slight dispersion in the tiny installation area may result in defects in production.

Patent Literature 1: Japanese Published Patent Application No. 2002-10369 (FIG. 1)

DISCLOSURE OF INVENTION

The present invention is made to solve the above-described problems and to obtain left and right headphone apparatuses and an electronic apparatus as well as a cord-winding device and cord-winding method, which are inexpensive and small-sized and in which the installation angle of brush-like contact points is stable, it is not necessary to weld the brush-like contact points to a thin reel, assembly is easy, jigs and tools are not required, and reduction in the number of defective products and reduction in investment in assembly are facilitated can be achieved.

BEST MODE FOR CARRYING OUT THE INVENTION

Figure 1:
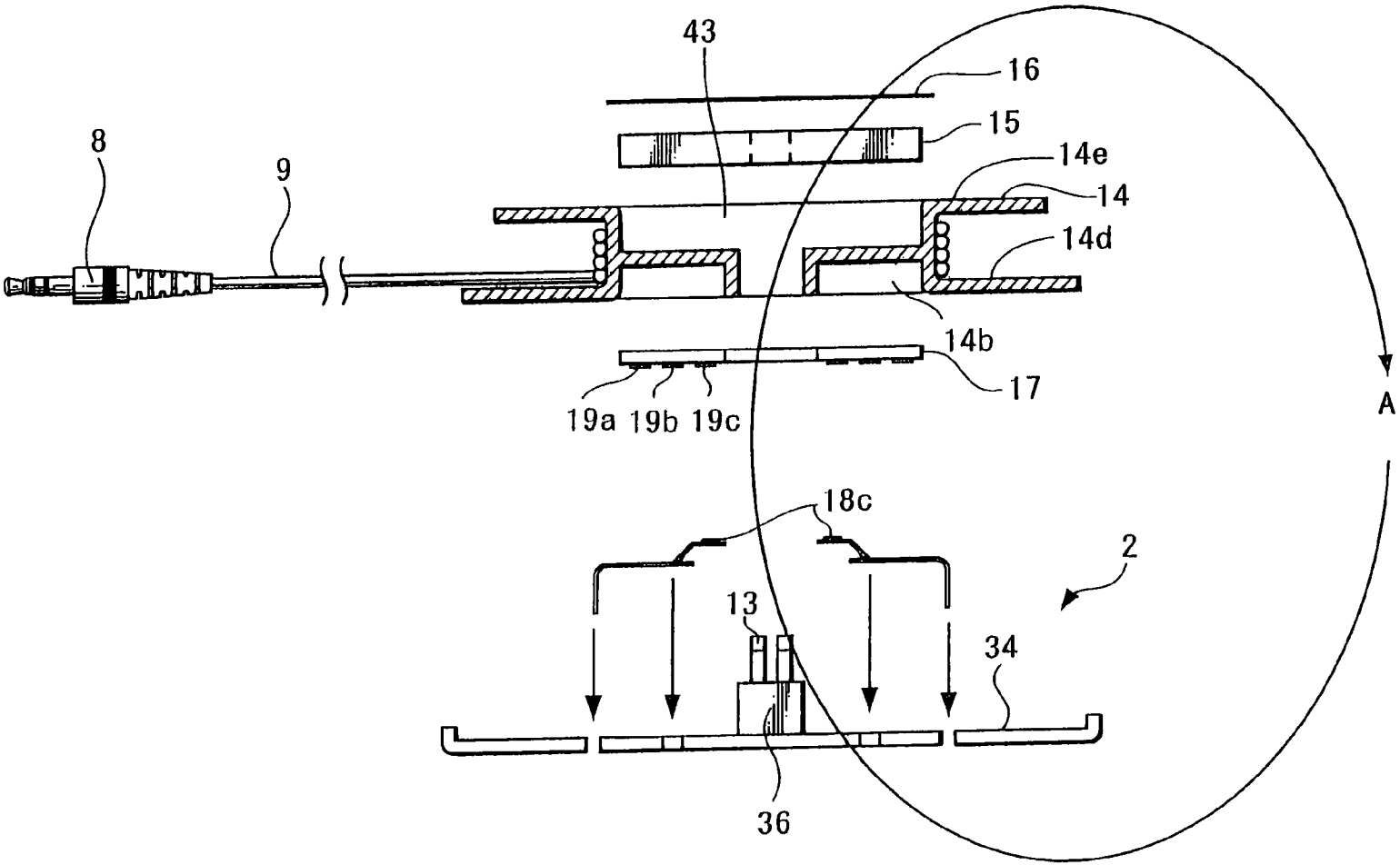
FIG. 1 is a side sectional view showing an assembled state of cord-winding means according to an embodiment of a headphone apparatus of the present invention.
Figure 2:
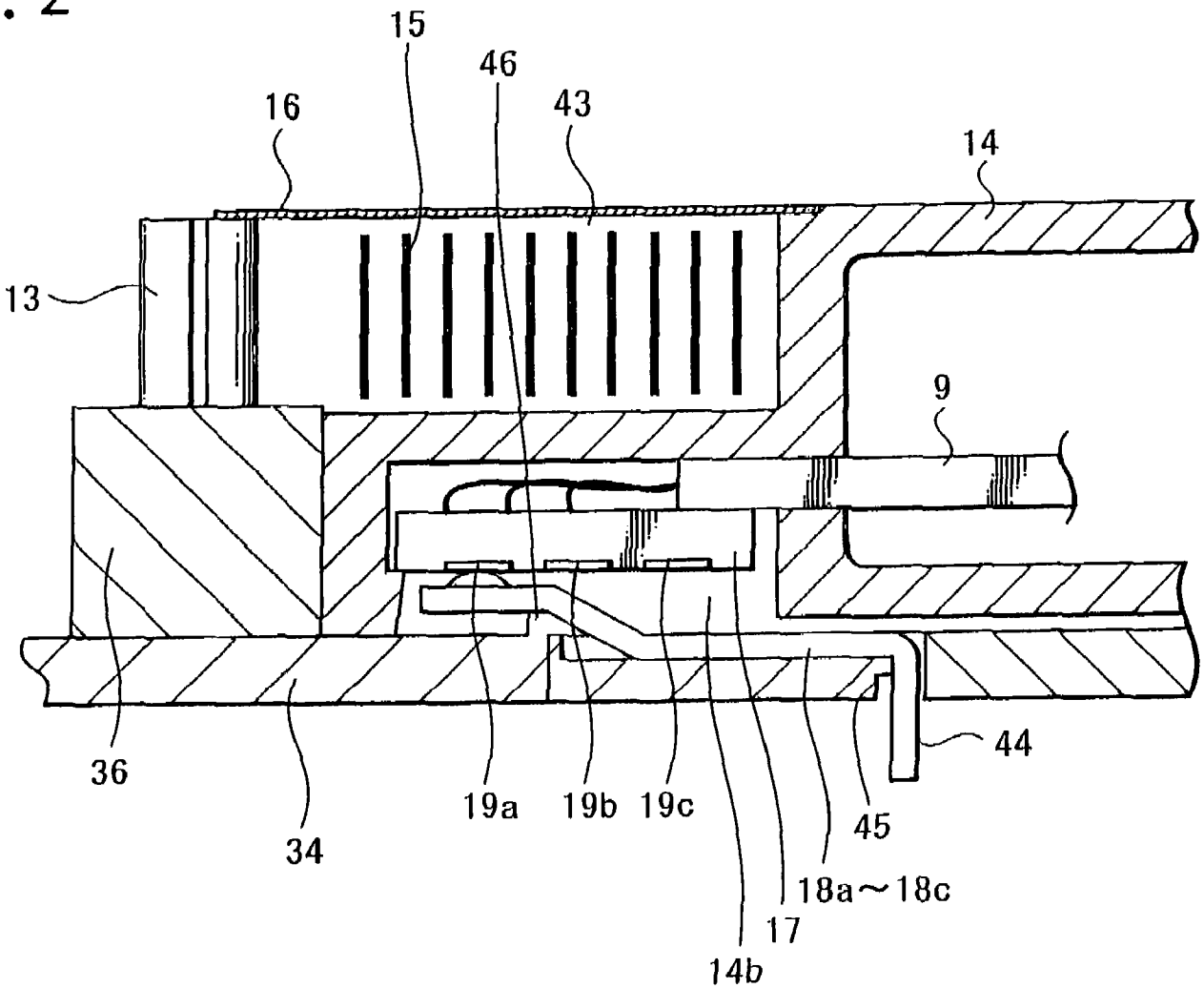
FIG. 2 is an enlarged view of the portion A in FIG. 1 according to an embodiment of a headphone apparatus of the present invention.
Figure 3:
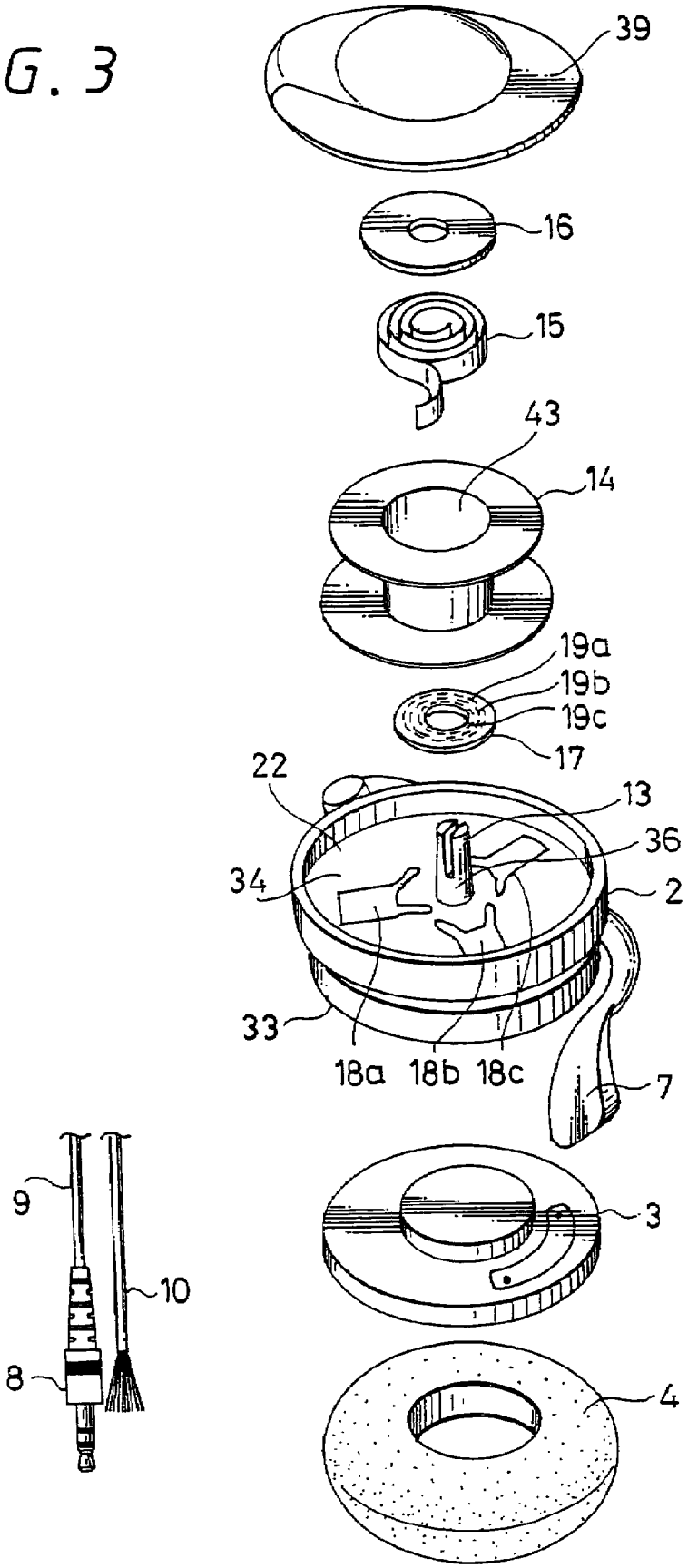
FIG. 3 is a perspective view showing an assembling state of cord-winding means according to an embodiment of a headphone apparatus of the present invention.
Figure 4A:
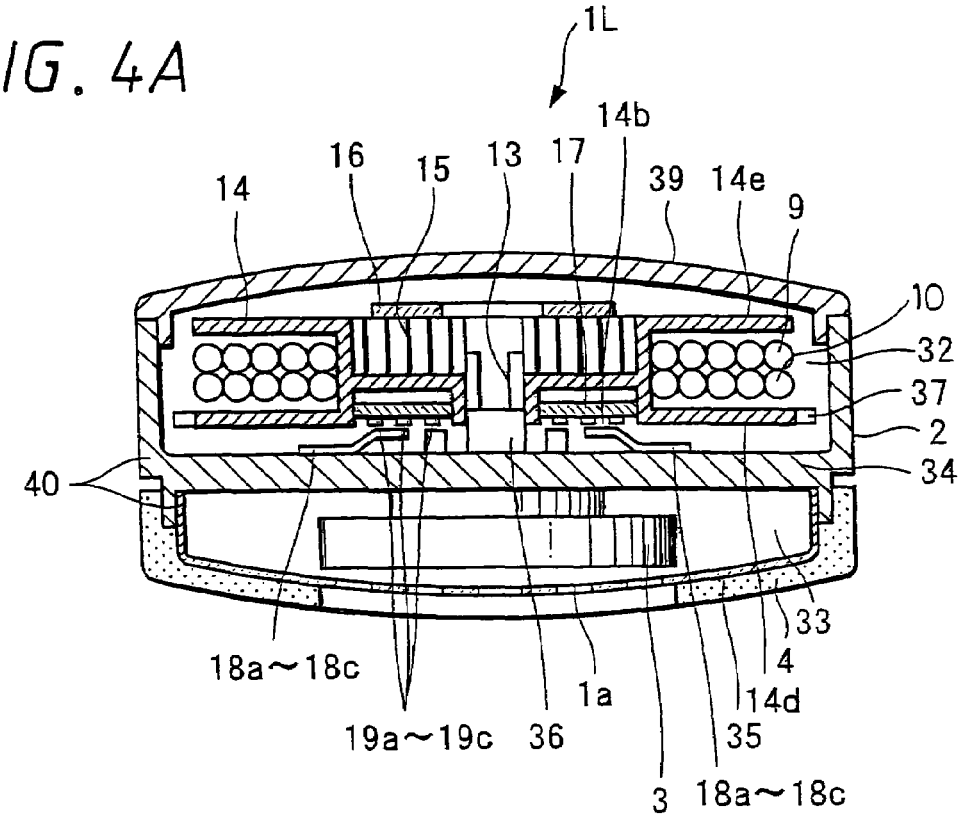
FIGS. 4A and 4B are a side sectional view and a plan view of relevant parts according to an embodiment of a headphone apparatus of the present invention.
Figure 4B:
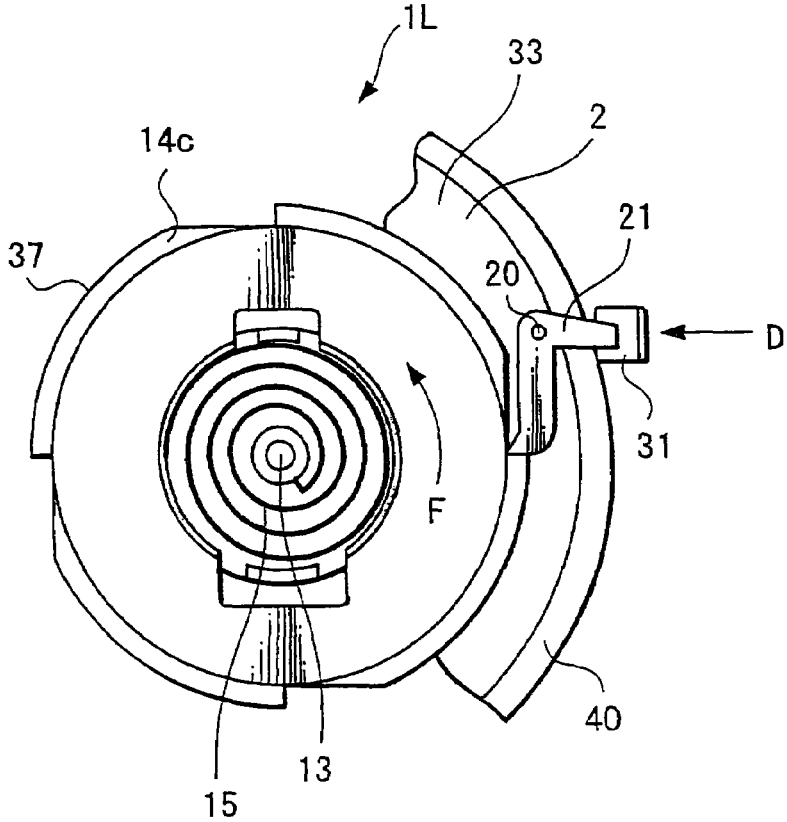
Figure 5A:
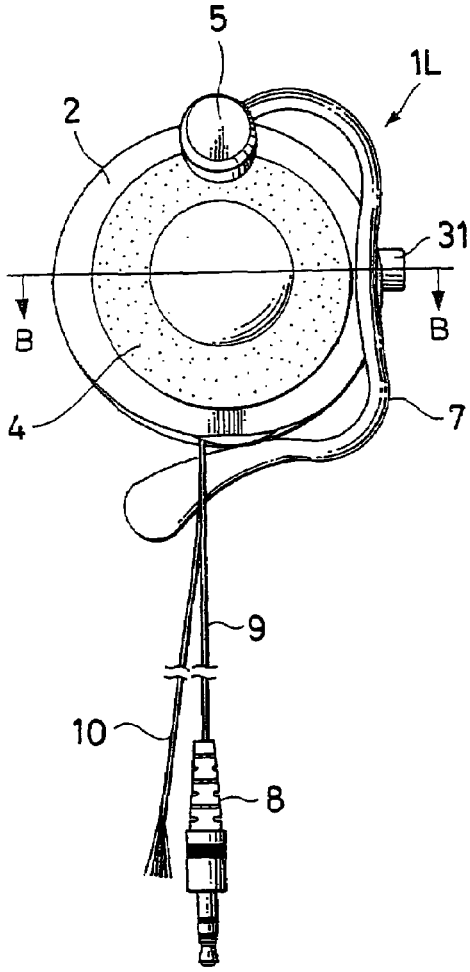
FIGS. 5A and 5B are an external front view and a side view according to an embodiment of a headphone apparatus of the present invention.
Figure 5B:
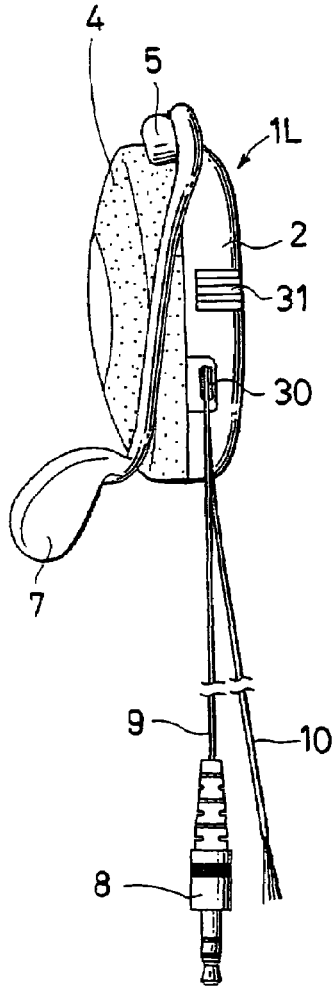
Figure 6:
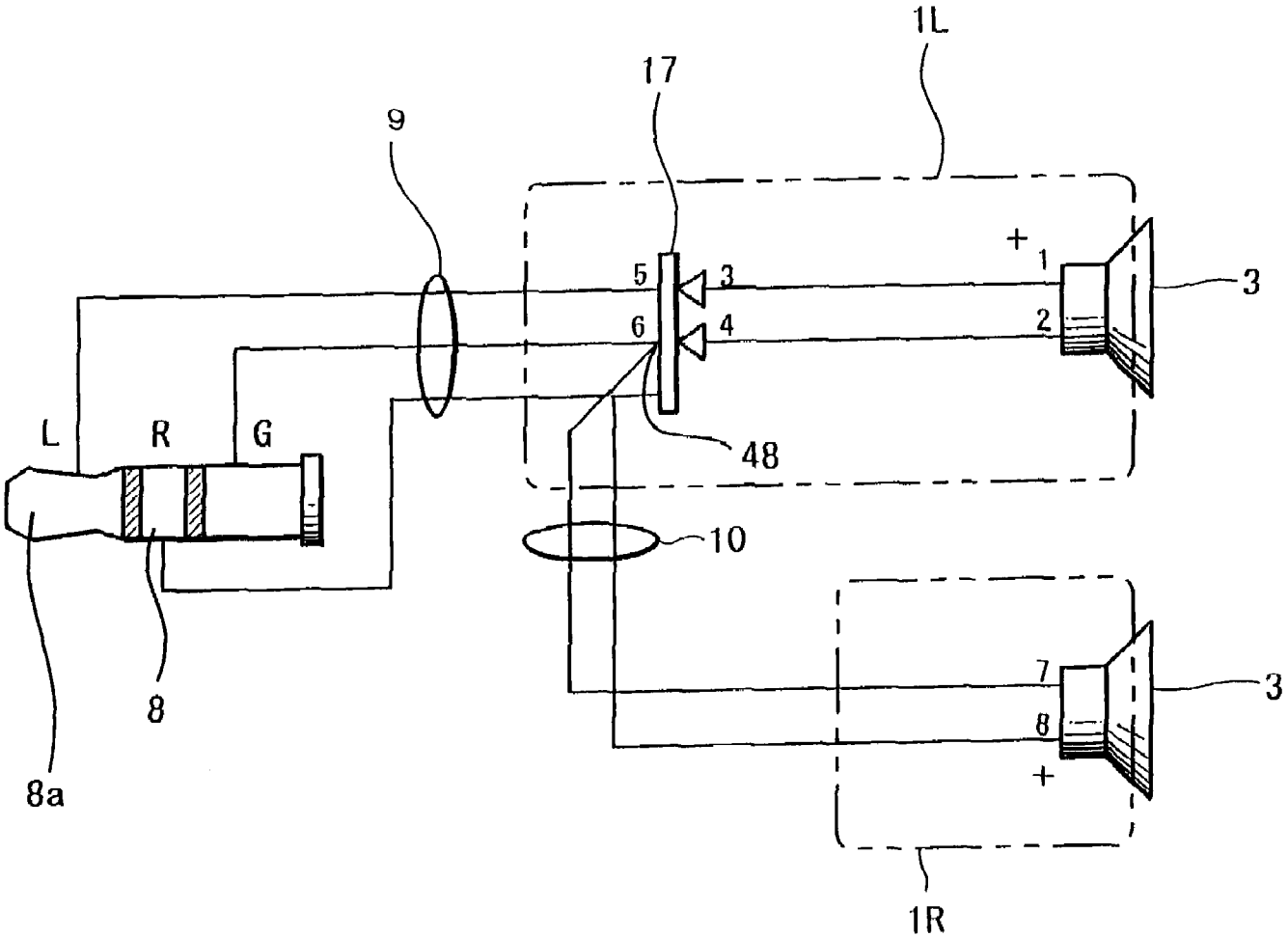
FIG. 6 is a wiring diagram for explaining a soldered position using a continuous leading wire when two cords are simultaneously wound according to an embodiment of a headphone apparatus of the present invention.
Figure 7A:
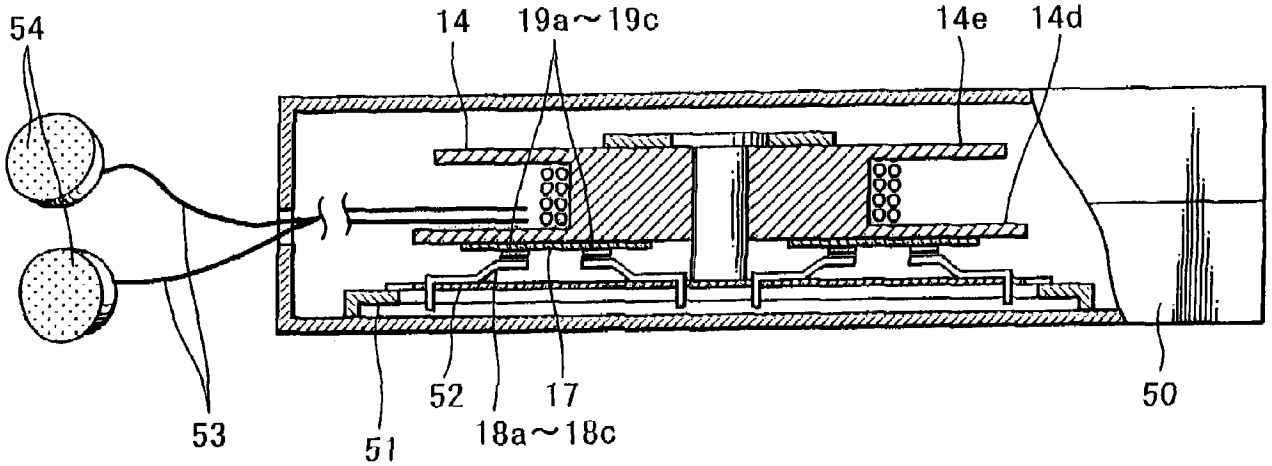
FIGS. 7A and 7B are partly sectional side views showing relevant parts of cord-winding means according to an embodiment of an electronic apparatus of the present invention.
Figure 7B:
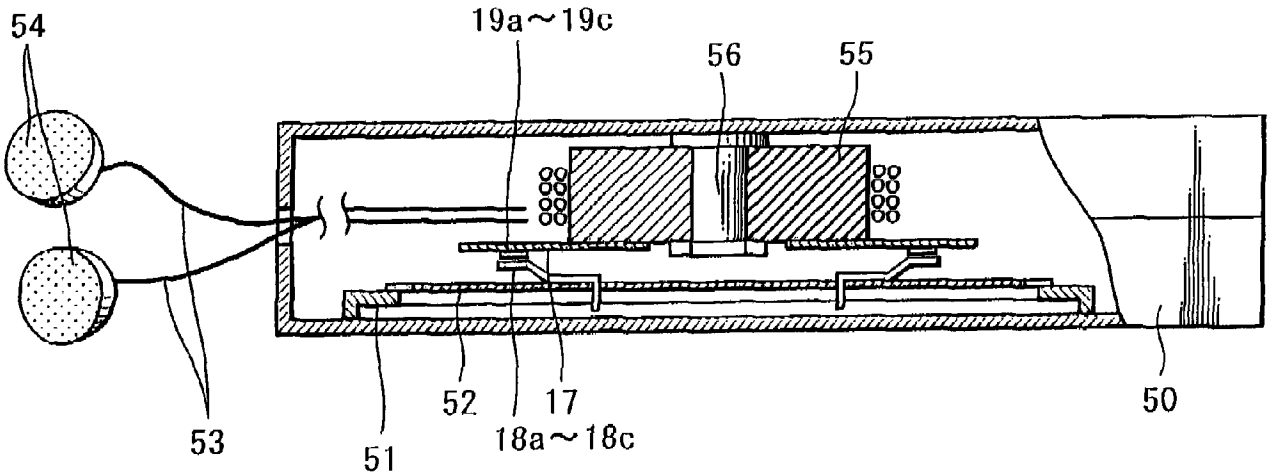

Hereinafter, an embodiment of a headphone apparatus of the present invention will be explained based on the drawings. FIG. 1 is a side sectional view showing the assembled state of a cord-winding part of an embodiment of a headphone apparatus of the present invention; FIG. 2 is an enlarged view of the portion A in FIG. 1; FIG. 3 is a perspective view showing the assembling state of a headphone apparatus of the present invention; FIGS. 4A and 4B are a side sectional view of the relevant parts and a plan view for explaining locking means respectively, showing a cord-winding part of an embodiment used for a headphone apparatus of the present invention; FIGS. 5A and 5B are a plan view and a side view respectively showing the outer appearance of a headphone apparatus of the present invention; FIG. 6 is a wiring diagram in which two kinds of cords of a headphone apparatus of the present invention are simultaneously wound around one winding means; and FIGS. 7A and 7B are side sectional views showing structures in which winding means of the present invention are applied to an electronic apparatus.

Prior to explanation of FIGS. 1 to 3, the whole construction of a headphone apparatus of the present invention is explained referring to FIGS. 4A and 4B and FIG. 5. Note that portions corresponding to those in the conventional headphone apparatus explained referring to FIGS. 8 to 12 will be given the same numerals to be explained.

Figure 8:
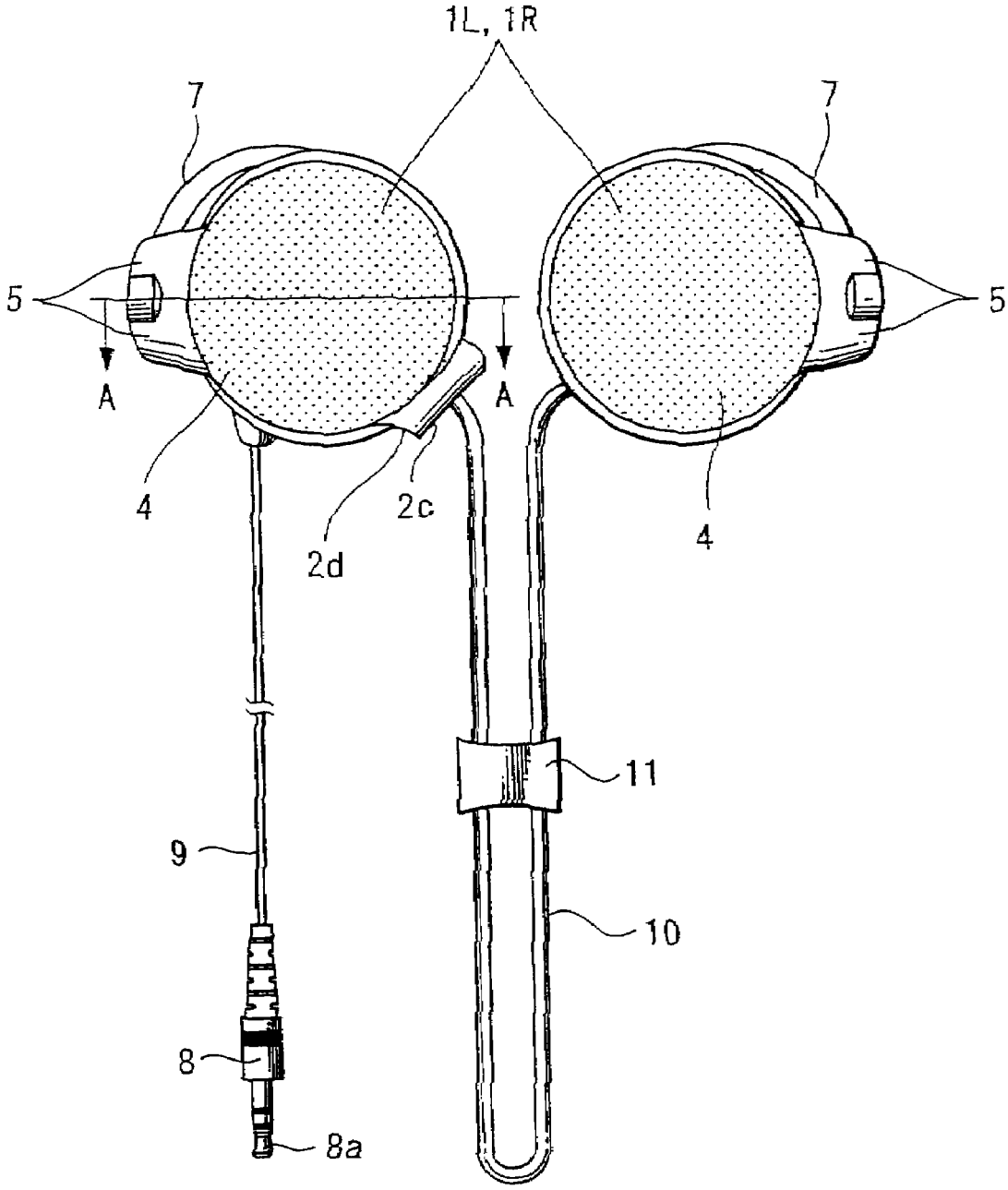
FIG. 8 Related Art
FIG. 8 is a plan view showing the outer appearance of a headphone apparatus of related art.
Figure 9:
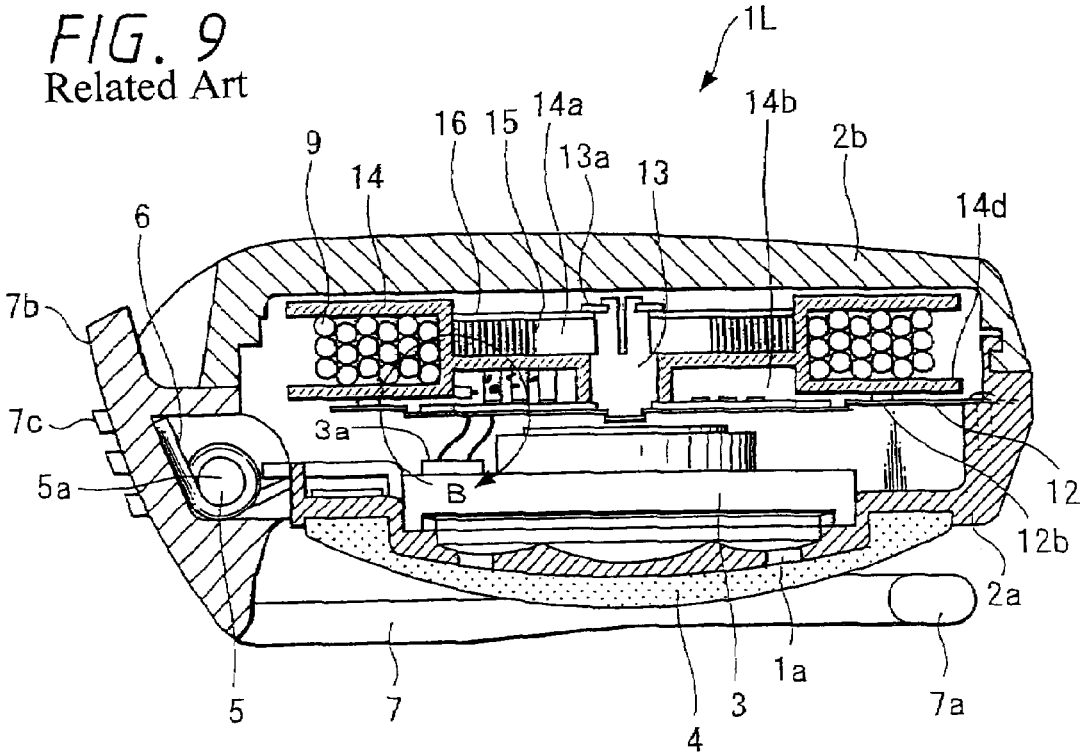
FIG. 9 Related Art
FIG. 9 is a side sectional view showing relevant parts of cord-winding means of a headphone apparatus of related art.
Figure 10:
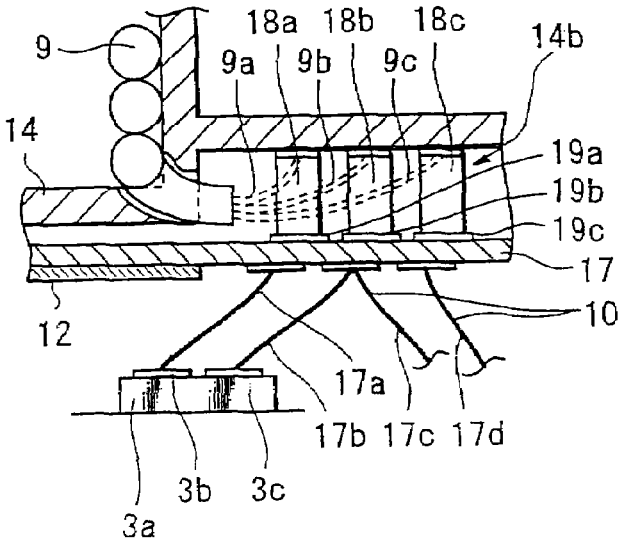
FIG. 10 Related Art
FIG. 10 is an enlarged view of the portion B in FIG. 9, showing a headphone apparatus of related art.
Figure 11:
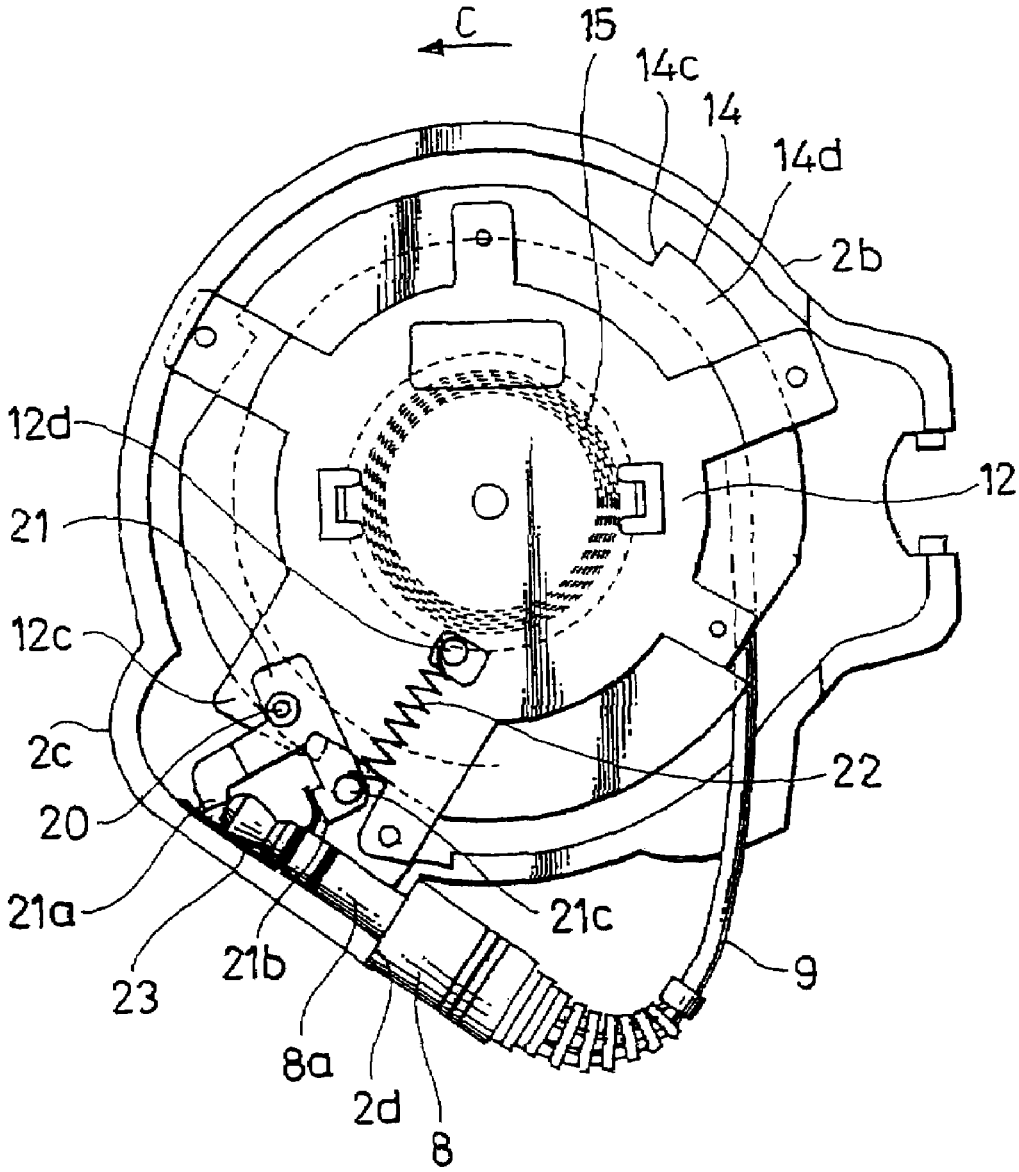
FIG. 11 Related Art
FIG. 11 is a plan view showing relevant parts of cord-winding means of a headphone apparatus of related art.
Figure 12A:
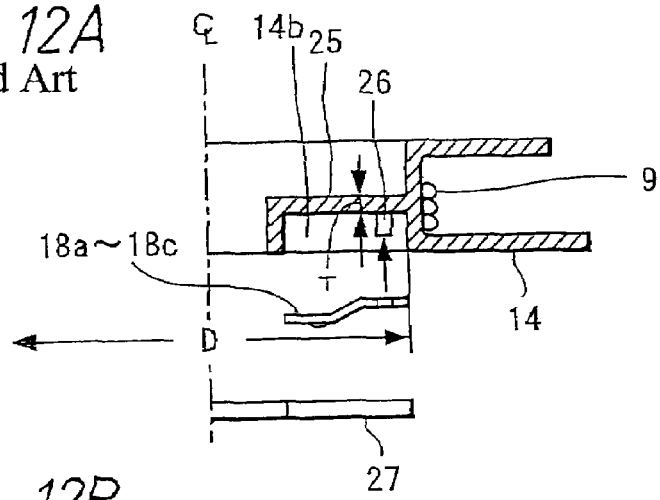
FIG. 12A Related Art
FIGS. 12A to 12C are side sectional views for explaining a method to assemble a commutator of cord-winding means of a headphone apparatus of related art.
Figure 12B:
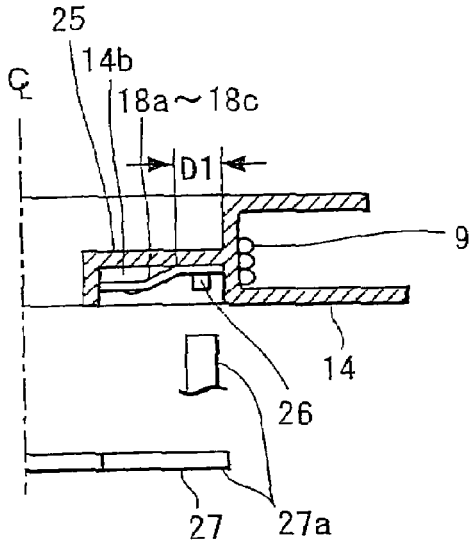
FIG. 12B Related Art
Figure 12C:
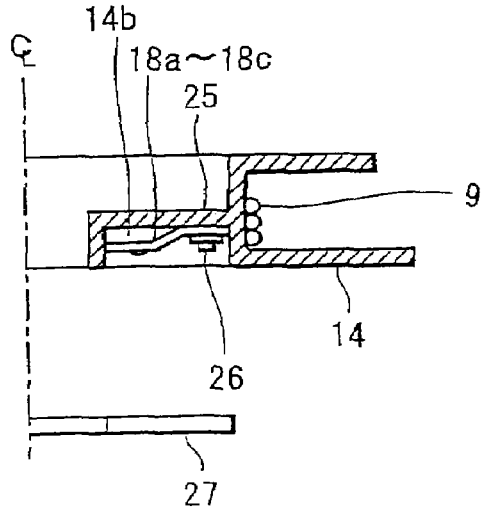
FIG. 12C Related Art

FIGS. 5A and 5B show a left headphone housing 1L in left and right headphone apparatuses; it should be noted that a headphone apparatus of the present invention includes a pair of left and right headphone housings 1L and 1R, as explained in FIG. 8.

First, based on FIGS. 5A and 5B, only the left headphone housing 1L is explained below, on the grounds that the pair of left and right headphone housings 1L and 1R is constructed in a laterally symmetrical manner to have the same internal structure.

FIGS. 5A and 5B are external views showing the whole construction of an ear-hook type headphone apparatus of the present invention and the left headphone housing 1L has a structure, in which an ear pad 4 is attached to a housing 2 approximately shaped like a shell, an approximately C-shaped ear hook 7 molded with synthetic resin is pivotally fitted in a freely turnable manner to a spindle portion 5 formed on the periphery of the housing 2, and an input cord 9 with an input plug 8 connected to the end thereof and a passage cord 10 can be wound and retracted simultaneously by winding means provided in the housing 2.

Further, the input cord 9 to which the input plug 8 is attached and the passage cord 10 are led out from a notch-like opening portion 30 provided in the vicinity of the housing 2. Although two cords are led out from one opening portion 30 in the construction of FIG. 5B, two opening portions may be provided and the input cord 9 and the passage cord 10 are led out separately to be wound between different flanges of a reel 14 such that the two cords can be prevented from tangling.

In FIGS. 5A and 5B, a reference numeral 31 described later on is a release button to release by means of a pressing operation the lock of a ratchet mechanism including a locking piece 21 and ratchet wheels 14*c* and to release the two cords, namely, the input cord 9 and the passage cord 10 wound inside the winding means.

FIG. 4A is a cross sectional view of FIG. 5A shown by the B-B line. In FIG. 4A, the headphone housing 1L includes the housing 2 made of synthetic resin or the like having circular ribs 40 with a lower space 33 and an upper space 32 provided in the vicinity of the front and back of an approximately circular board 34.

A D/U 3 such as a loudspeaker is provided in the lower space 33 surrounded by the front rib 40 of the above-described housing 2, and in front of the D/U 3 a sound emission board 35 molded of synthetic resin or the like with a plurality of sound holes 1*a* is fitted into the inner circumference of the front rib. The ring-shaped ear pad 4 formed of expandable polyurethane or the like is attached to the outer circumference of the front rib 40.

In the center of the upper space 32 surrounded by the ring-shaped rear rib 40, a rotating shaft 13 functioning as a pivot is provided in an upright position from a bearing 36 of the board 34 of the housing 2, a terminal board 17 patterned with metal slip rings 19*a*, 19*b*, 19*c* is fitted into a bored portion 14*b* provided at the lower end of the hub of a reel 14, and one end of the input cord 9 and/or the passage cord 10 wound around the reel 14 is connected to the metal slip rings 19*a*, 19*b*, 19*c*. Brush-like contact points 18*a*, 18*b*, 18*c* are fixed to the board 34 of the housing 2. The reel 14 around which the input cord 9 and the passage cord 10 are wound and stored is pivotally fitted to the rotating shaft 13 in a freely turnable manner. Around the circumference of a lower flange 14*d* of the reel 14 are formed the ratchet wheels 14*c* with cams 37.

A spring 15 formed of a leaf spring is provided in the reel 14, and the locking piece 21 constituting the ratchet mechanism which locks the cams 37 provided on the ratchet wheels 14*c* as shown in FIG. 4B is provided on the lower surface of the reel 14; when the release button 31 which constitutes locking means with the cams 37 and locking piece 21 is pressed by hand or the like, a locked state between the cam 37 and locking piece 21 is released, and so the input cord 9 and the passage cord 10 are simultaneously wound between the upper and lower flanges 14*d* and 14e formed above and below the hub of the reel 14 by the winding force of the spring 15. In FIG. 4A, a reference numeral 39 is a housing cap molded of synthetic resin, which is shaped like a dome to cover the upper space 32.

In FIG. 4B, the approximately L-shaped locking piece 21 is pivotally fitted in the upper space 32 inside the ring-shaped rib 40 of the housing 2 in a freely turnable manner with a shaft 20 as a center, as opposed to the cams 37 formed in the vicinity of the lower flange 14*d* of the reel 14; and one end of the locking piece 21 is biased by a biasing spring not shown in the figure to be capable of contacting along the cams 37 of the ratchet wheels 14*c*.

The release button 31 is inserted and fitted into the other end of the approximately L-shaped locking piece 21. When the release button 31 is pressed in the direction of an arrow D, the end of the locking piece 21 detaches from a stepped portion of a cam 37 and therefore by the work of the spring 15 incorporated in the reel 14, the two cords of the input cord 9 to which the input plug 8 is attached and the passage cord 10 are wound and stored as the reel 14 rotates with the rotating shaft 13 as a center.

When the input cord 9 and the passage cord 10 wound and stored in a space between the upper and lower flanges 14*d* and 14*e* formed above and below the hub of the reel 14 in this manner are pulled out, those two cords of the input cord 9 and the passage cord 10 are pulled out with the hand or the like in FIG. 4A and so the cords can be pulled out intermittently as the locking piece 21 moves beyond a cam 37 in the direction of an arrow F (counterclockwise direction) with the rotating shaft 13 of the reel 14 as a center in FIG. 4B.

Next, a commutator mechanism of the present invention is described in detail referring to FIGS. 1 to 3. A commutator mechanism of the present invention includes brush-like contact points 18*a*, 18*b*, 18*c* and a terminal board 17 on which metal slip rings 19*a*, 19*b*, 19*c* are formed. In the side sectional view and the perspective view of FIGS. 1 and 3 each showing the assembling state of a collecting mechanism of a cord-winding part, a rotating shaft 13 into which a reel 14 is fitted in a freely turnable manner is formed on a bearing 36 provided in an upright position at the approximate center on a board 34 of a housing 2, and each of brush-like horn-shaped metal contact points 18*a*, 18*b*, 18*c* made of phosphor bronze, beryllium or the like is installed at a position to divide the circumference into three portions as shown in FIG. 3, with the rotating shaft 13 as the center. In this case, when attaching to the board 34 of the housing 2, the metal contact points 18*a*, 18*b*, 18*c* only require to be inserted and fixed in a through-hole 45, formed in the board 34 as shown in FIG. 2, in which a metal contact point terminal 44 can be inserted; and the contact points of the metal contact points 18*a*, 18*b*, 18*c* can always be contact with the metal slip rings 19*a*, 19*b*, 19*c* of the terminal board 17 by means of a pressing piece 46 formed on the board 34. Therefore, an operation of welding the metal contact points 18*a*, 18*b*, 18*c* can be omitted.

The terminal board 17 patterned with the metal slip rings 19*a*, 19*b*, 19*c* in the shape of rings and concentric circles at the positions opposite to the above-described brush-like contact points 18*a*, 18*b*, 18*c* is fitted into a bored portion 14*b* formed between the inner circumference and the hub of a lower flange 14*d* of the reel 14, as shown in FIG. 2. On the upper part of the reel 14, in an upper space 43 is inserted a spring 15 whose one end is locked in a slit portion of the rotating shaft 13 and whose other end is locked on the reel 14, a pressing board 16 is laid over the spring 15, the pressing board 16 is fixed to the rotating shaft 13 with a C ring or the like, and an upper space 22 of the housing 2 is covered with a housing cap 39.

Further, a D/U 3 is installed in a lower space 33 of the housing 2 as shown in FIG. 3, and an ear pad 4 is installed with a sound emission board 35 (refer to FIG. 4) provided in between. An input cord 9 and a passage cord 10 are wound around the reel 14, and an end on one side of the input cord 9 and/or the passage cord 10 is connected to the metal slip rings 19*a*, 19*b*, 19*c* of the terminal board 17 by means of soldering or the like as shown in FIG. 2.

FIG. 6 is a wiring diagram for explaining a position where soldering is performed on a terminal board 17, in the case where two cords of an input cord 9 and a passage cord 10 are wound and stored in one reel 14, and the coating of the input cord 9 and passage cord 10 are peeled in the middle to make a peeled portion 48 to which the terminal board 17 is soldered, and so a continuous conductor (single conductor) is made.

In the case where one winding means is provided in the left headphone housing 1L and two kinds of cords are wound simultaneously, it is necessary to perform soldering on the terminal board 17, in order for a signal input from the input cord 9 with a connection terminal 8*a* including a left L, a right R and a ground G of an input plug 8 (or output from a microphone of a stereo headset), for example, to a D/U 3 (L) in the left headphone housing 1L through the terminal board 17 to be provided to a D/U 3 (R) in the right headphone housing 1R through the passage cord 10 connecting the left and right headphone housings 1L and 1R, as shown in FIG. 6; however, there has been a problem in which such soldering is a major cause of the occurrence of defects because of uncertainty in manual work.

In the present invention, if the peeled portion 48 is formed by peeling off the coating of the middle part of the G lead wire of the input cord 9 before the terminal board 17 is pressed and inserted in a bored portion 14*b* of the reel 14 as shown in FIG. 6, the peeled portion 48 is soldered to the terminal board 17 as shown by the small FIG. 6, and the rest of the G input cord 9 on the hot side is directly connected to the D/U 3 (R) of the right headphone housing 1R through the terminal board 17, and so only two positions of soldering are required on the terminal board 17 as shown by the small FIGS. 5 and 6, thereby enabling a lot of soldering to be omitted and soldering to be made using a large place.

Specifically, since a soldering operation and a welding operation between the end of the input cord 9 and the plug-like contact points 18*a*, 18*b*, 18*c* provided in the bored portion 14*b* of the above-described typical small left and right headphone housings 1L and 1R are omitted, the cause leading to complexity and the occurrence of failure is removed and percent defective can be expected to be reduced; and also, since a conductor of the input cord 9 is a single component without any discontinuity, improvement in reduced sound quality due to transmission loss (high sound quality) and improvement in reliability can be obtained.

FIG. 7A shows a side sectional view of the relevant parts, in the case where winding means of the present invention is installed in an electronic apparatus such as a portable radio receiver, portable recording and reproducing apparatus, mobile phone unit or personal digital assistant (PDA). In FIG. 7A, a reference numeral 50 denotes a casing, in this casing 50 or a casing 50, brush-like contact points 18*a*, 18*b*, 18*c* are provided on an insulating board 52 of an arrangement chassis 51, and a terminal board 17 patterned with metal slip rings 19*a*, 19*b*, 19*c* is provided on the reel 14 side. In this case, to the end of input and output cord 53 wound around the reel 14 are connected left and right earphones, headphones, a microphone, an input plug (connector including an input jack) and an output plug (connector including an output jack) 54. In this case, a terminal board 17 is attached to a lower flange 14*d* of the reel 14, however, the lower flange 14*d* of the reel 14 may be directly patterned with metal slip rings 19*a*, 19*b*, 19*c*.

FIG. 7B shows a structure in which a pivot 56 is provided in an upright position in the upper half body of a casing 50, a drum 55 is pivotally fitted to this pivot 56 in a freely turnable manner and a disk-like terminal board 17 having a diameter larger than the drum 55 is fixed to the lower edge of the drum 55, and input and output cords 53 are wound around the drum.

INDUSTRIAL APPLICABILITY

A ratchet mechanism including ratchet wheels with cams and a claw of a locking piece has been explained as the above-described winding means, however, it is obvious that locking means for stopping rotation using a disk braking method, a gear and ratchet method, a claw and claw crown method and the like can be employed instead of the above mechanism. Further, although ratchet wheels are provided in the vicinity of a flange of a reel in the above-described structure, different ratchet wheels may be provided instead of those ratchet wheels, or a reel can be replaced by a drum or the like. Further, needless to say, the present invention can be applied to a microphone-attached headphone set.

The invention claimed is:

1. A headphone apparatus capable of winding and storing a cord around a reel pivotally fitted in a freely turnable manner to a pivot in a headphone housing, comprising:

contact points provided in said headphone housing; and a terminal board provided in said reel and fixedly coupled to said reel so as to turn relative to the pivot as the reel turns relative to the pivot, which terminal board includes metal slip rings.

2. A headphone apparatus according to claim 1, wherein said terminal board is provided on the lower surface of said reel, said contact points are provided at a position opposed in a bored portion of the reel, and two or more kinds of cords are simultaneously wound around the reel.

3. The headphone apparatus according to claim 2, wherein a peeled portion including a partially peeled ground input cord of an input plug connected to a drive unit in said headphone housing is connected to terminals of said metal slip rings, and an end of the input cord continuing from the peeled portion to be a passage cord is connected to a ground terminal of the drive unit.

4. The headphone apparatus according to claim 1, wherein a peeled portion including a partially peeled ground input cord of an input plug connected to a drive unit in said headphone housing is connected to terminals of said metal slip rings, and an end of the input cord continuing from the peeled portion to be a passage cord is connected to a ground terminal of the drive unit.

5. The headphone apparatus according to claim 1, further comprising brush contact points fixedly coupled to the headphone housing and disposed in contact with the metal slip rings.

6. The headphone apparatus according to claim 5, wherein the brush contacts are disposed on two opposite sides of an axis of rotation of the reel.

7. The electronic apparatus capable of winding and storing a cord around a reel pivotally fitted in a freely turnable manner to a pivot provided in an upright position in a casing of a portable electronic apparatus, comprising:

contact points provided in said casing of the electronic apparatus, and a terminal board provided in said reel and fixedly coupled to said reel so as to turn relative to the pivot as the reel turns relative to the pivot, which terminal board includes metal slip rings.

8. The electronic apparatus according to claim 7, wherein said terminal board is provided on the lower surface of said reel, said contact points are provided at a position opposed in a bored portion of the reel, and two or more kinds of cords are simultaneously wound around the reel.

9. The electronic apparatus according to claim 8, wherein a peeled portion including a partially peeled ground input cord of an input plug connected to a drive unit in said casing is connected to terminals of said metal slip rings, and an end of the input cord continuing from the peeled portion to be a passage cord is connected to a ground terminal of the drive unit.

10. The electronic apparatus according to claim 7, wherein said reel includes a hub or a hub and upper and lower flanges; said terminal board is provided on the lower surface of the reel; brushes of said contact points are provided, in the electronic apparatus casing, opposed to said metal slip rings on the terminal board; and two or more kinds of cords are simultaneously wound around the reel.

11. The electronic apparatus according to claim 10, wherein a peeled portion including a partially peeled ground input cord of an input plug connected to a drive unit in said casing is connected to terminals of said metal slip rings, and an end of the input cord continuing from the peeled portion to be a passage cord is connected to a ground terminal of the drive unit.

12. The electronic apparatus according to claim 7, wherein a peeled portion including a partially peeled ground input cord of an input plug connected to a drive unit in the casing is connected to terminals of said metal slip rings, and an end of the input cord continuing from the peeled portion to be a passage cord is connected to a ground terminal of the drive unit.

13. A cord-winding device configured to wind and store a cord around a reel pivotally fitted in a freely turnable manner to a pivot in a headphone housing or casing, comprising:

contact points provided in said headphone housing or casing, and a terminal board provided in said reel and fixedly coupled to said reel so as to turn relative to the pivot as the reel turns relative to the pivot, which terminal board includes metal slip rings.

14. The cord-winding device according to claim 13, wherein a peeled portion including a partially peeled ground input cord of an input plug connected to a drive unit in said headphone housing or in said casing is connected to terminals of said metal slip rings, and an end of the input cord continuing from the peeled portion to be a passage cord is connected to a ground terminal of the drive unit.

* * * * *